US005992602A

United States Patent [19]

Zwieg et al.

[11] Patent Number: 5,992,602

[45] Date of Patent: Nov. 30, 1999

[54] COIN RECOGNITION AND OFF-SORTING IN A COIN SORTER

[75] Inventors: Robert L. Zwieg, Watertown; Thomas P. Adams, Oconomowoc; Myron W. Spoehr, Lake Mills; Robert F. Fredrick, Watertown; Jon R. Stieber, Oconomowoc; John P. Grajewski, Palmyra, all of Wis.

[73] Assignee: De La Rue Systems Americas Corporation, Watertown, Wis.

[21] Appl. No.: 08/887,442

[22] Filed: Jul. 2, 1997

Related U.S. Application Data

[63] Continuation of application No. PCT/US97/00458, Jan. 9, 1997

[60] Provisional application No. 60/009,908, Jan. 11, 1996.

[51] Int. Cl.[6] ..... G07D 5/08; G07D 3/06; G07D 1/00

[52] U.S. Cl. ..... 194/317; 453/10; 453/12; 453/32

[58] Field of Search ..... 194/317, 318; 453/10, 12, 6, 32

[56] References Cited

U.S. PATENT DOCUMENTS

| | | | |
|---|---|---|---|
| 4,147,175 | 4/1979 | Webb | 133/3 D |
| 4,172,222 | 10/1979 | Eglise | 194/317 |
| 4,353,453 | 10/1982 | Partin et al. | 194/100 A |
| 4,362,177 | 12/1982 | Furuya | 133/8 R |
| 4,370,990 | 2/1983 | Watanabe | 133/8 A |
| 4,474,281 | 10/1984 | Roberts et al. | 194/1 N |
| 4,548,220 | 10/1985 | Le Hong et al. | 453/3 |
| 4,556,140 | 12/1985 | Okada | 194/4 C |
| 4,558,711 | 12/1985 | Yoshiaki et al. | 133/3 F |
| 4,664,244 | 5/1987 | Wright | 194/317 |
| 4,681,204 | 7/1987 | Zimmermann | 194/317 |
| 4,749,074 | 6/1988 | Ueki et al. | 194/317 |
| 4,775,354 | 10/1988 | Rasmussen et al. | 453/10 |
| 4,805,754 | 2/1989 | Howells | 194/317 |
| 4,881,918 | 11/1989 | Goh et al. | 453/4 |
| 4,951,799 | 8/1990 | Kai | 194/317 |
| 4,993,990 | 2/1991 | Ozeki et al. | 453/7 |
| 5,011,455 | 4/1991 | Rasmussen | 453/10 |
| 5,123,873 | 6/1992 | Rasmussen | 453/10 |
| 5,131,518 | 7/1992 | Shimizu | 194/318 |

(List continued on next page.)

FOREIGN PATENT DOCUMENTS

| | | |
|---|---|---|
| 0 021 567 A2 | 1/1981 | European Pat. Off. . |
| 0 295 862 A2 | 12/1988 | European Pat. Off. . |
| 0 660 274 A1 | 6/1995 | European Pat. Off. . |
| 2 542 475 | 3/1983 | France . |
| 28 29 285 | 2/1979 | Germany . |
| 2 272 320 | 5/1996 | United Kingdom . |
| WO 85/04037 | 9/1985 | WIPO . |
| WO 91/06928 | 5/1991 | WIPO . |
| WO 95/23387 | 8/1995 | WIPO . |

*Primary Examiner*—Christopher P. Ellis
*Assistant Examiner*—Bryan J. Jaketic
*Attorney, Agent, or Firm*—Quarles & Brady LLP

[57] ABSTRACT

A coin sorter has a circular sorting track with an upstanding rim. A diverter mechanism is located at the rim and may be actuated to move a selected coin away from the rim to an off-sort depression inwardly of the rim and then to an off-sort opening at the end of the depression. The diverter mechanism is actuated by a coin recognition system that includes an induction coil located beneath the track in advance of the diverter mechanism. Signals from the induction coil are read at spaced positions of a coin passing over the coil and compared with stored ranges of acceptable signals for coins of various denominations. The diverter mechanism is actuated to divert a coin to the off-sort opening when the signals for that coin do not fall within a range of acceptable values. The ranges of acceptable values can be established by calibrating the coin recognition system by processing a plurality of known acceptable coins of a denomination. The acceptable ranges can be automatically adjusted based upon the history of signals from acceptable coins processed after calibration.

21 Claims, 15 Drawing Sheets

U.S. PATENT DOCUMENTS

| | | | |
|---|---|---|---|
| 5,141,443 | 8/1992 | Rasmussen et al. | 453/10 |
| 5,191,957 | 3/1993 | Hayes | 194/318 |
| 5,207,611 | 5/1993 | Ueda et al. | 453/11 |
| 5,232,399 | 8/1993 | Le Hong et al. | 453/57 |
| 5,240,099 | 8/1993 | Brown et al. | 194/317 |
| 5,277,651 | 1/1994 | Rasmussen et al. | 453/10 |
| 5,295,899 | 3/1994 | Adams et al. | 453/10 |
| 5,299,977 | 4/1994 | Mazur et al. | 453/10 |
| 5,411,126 | 5/1995 | Seitz | 194/317 |
| 5,429,550 | 7/1995 | Mazur et al. | 453/10 |
| 5,453,047 | 9/1995 | Mazur et al. | 453/10 |
| 5,462,149 | 10/1995 | Waine et al. | 194/206 |
| 5,480,348 | 1/1996 | Mazur et al. | 453/10 |
| 5,507,379 | 4/1996 | Mazur et al. | 194/318 |
| 5,568,854 | 10/1996 | Hayes et al. | 194/318 |

FIG. 1
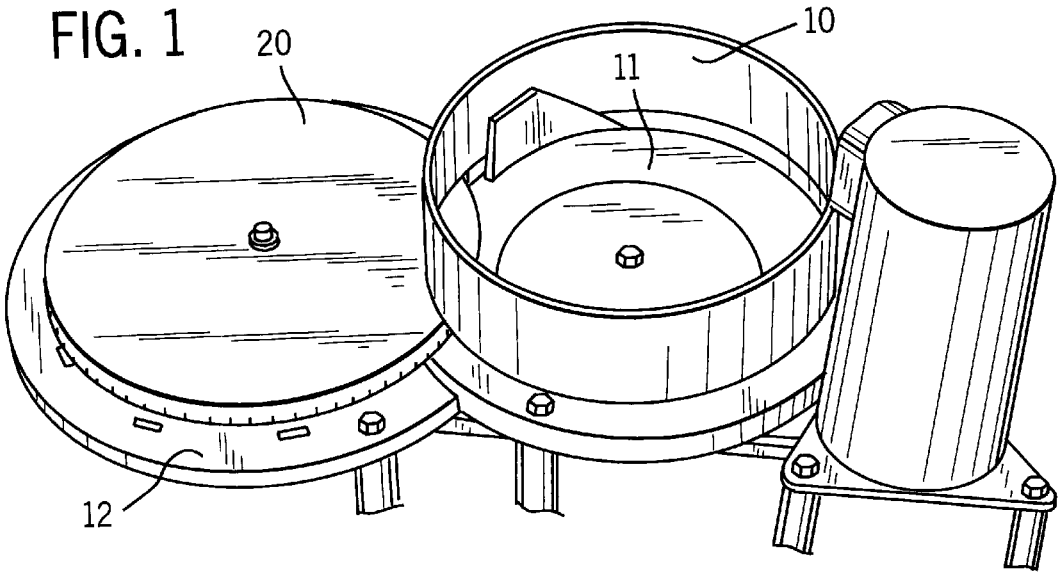
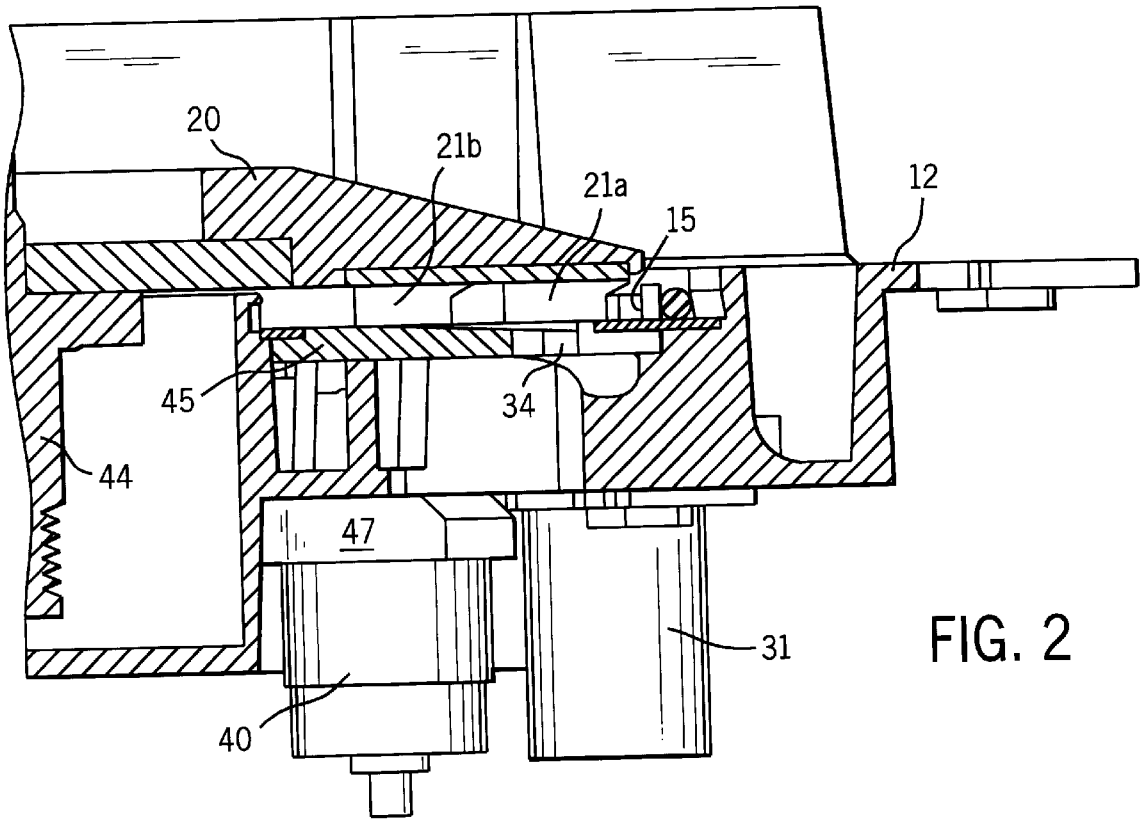
FIG. 2

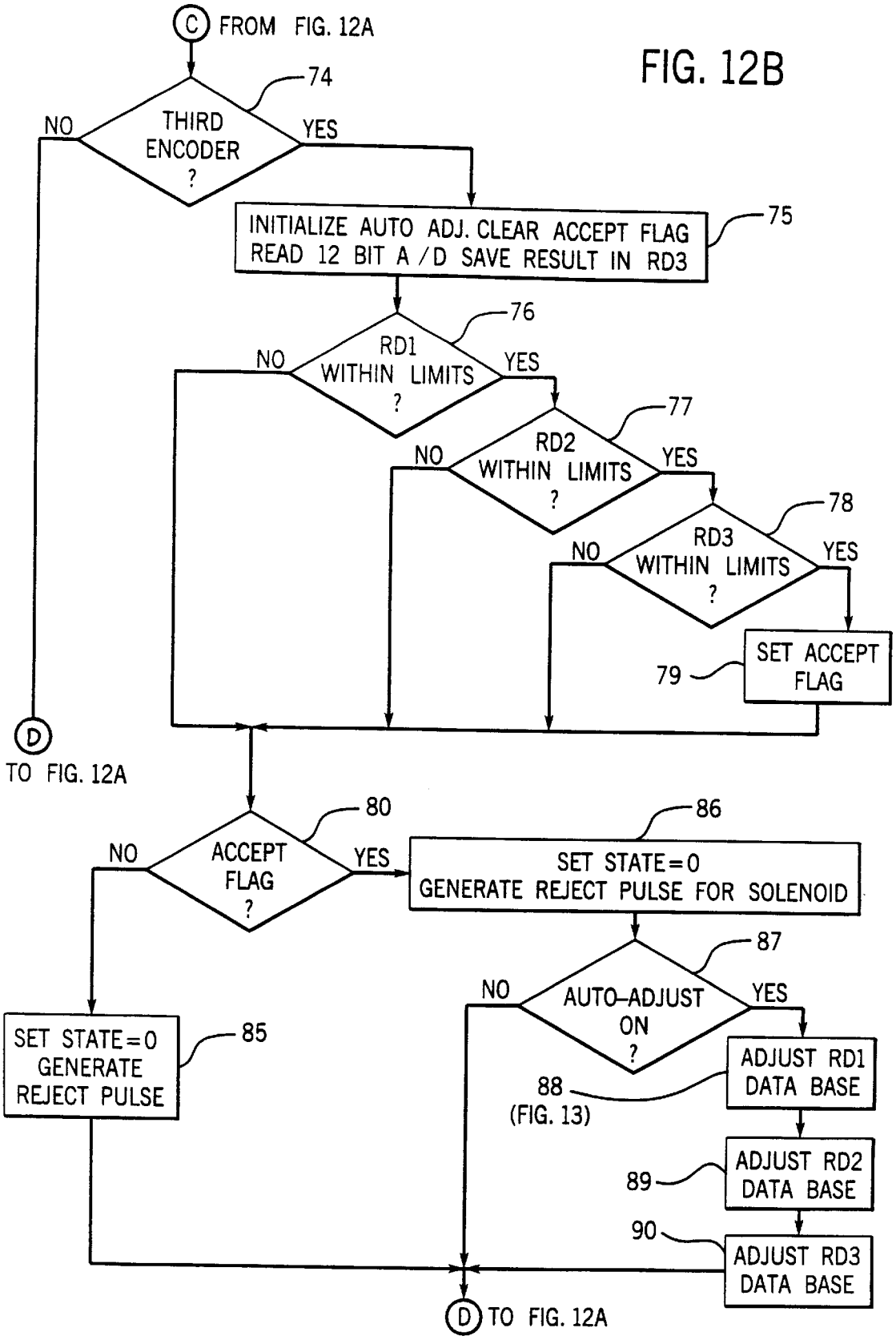
C FROM FIG. 12A
FIG. 12B
74
THIRD ENCODER ?
NO
YES
INITIALIZE AUTO ADJ. CLEAR ACCEPT FLAG READ 12 BIT A/D SAVE RESULT IN RD3
75
76
RD1 WITHIN LIMITS ?
NO
YES
77
RD2 WITHIN LIMITS ?
NO
YES
78
RD3 WITHIN LIMITS ?
NO
YES
SET ACCEPT FLAG
79
D
TO FIG. 12A
80
ACCEPT FLAG ?
NO
YES
86
SET STATE=0 GENERATE REJECT PULSE FOR SOLENOID
87
AUTO-ADJUST ON ?
NO
YES
SET STATE=0 GENERATE REJECT PULSE
85
ADJUST RD1 DATA BASE
88
(FIG. 13)
ADJUST RD2 DATA BASE
89
90
ADJUST RD3 DATA BASE
D TO FIG. 12A

COIN RECOGNITION AND OFF-SORTING IN A COIN SORTER

CROSS-REFERENCE TO RELATED APPLICATIONS

This application claims the benefit of U.S. Provisional Application No. 60/009,908 filed Jan. 11, 1996, and a continuation of International Application PCT/US97/00458 filed Jan. 9, 1997.

BACKGROUND OF THE INVENTION

This invention relates to coin handling, and particularly to an apparatus and method for recognizing and rejecting unwanted coins before the coins reach sorting stations in a coin sorter.

U.S. Pat. No. 5,295,899 issued Mar. 22, 1994, for "Two Disc Coin Handling Apparatus", discloses a coin sorter in which there is a rotating feed disc that forms the bottom of a coin hopper and a stationary sorter plate to one side of the feed disc. The sorter plate includes a circular sorting track that begins at a point adjacent to the perimeter of the feed disc. The sorter plate includes a series of spaced sorting openings each of which can be sized for a particular coin denomination. A second rotating disc has a series of resilient fingers extending downwardly from its underside. The second disc is mounted above and in close proximity to the upper surface of the sorter plate. The fingers partially overlap the upper surface of the feed disc. Coins deposited in the hopper are formed into a single file and a single layer, and the single file of coins is carried by the flexible fingers from the feed disc to the sorting track where the coins are sorted by size and counted as they pass through the sorting openings.

Coin sorters, including the sorter described in the above-identified patent, are typically configured to sort a particular mix of denominations of coins or tokens. While the mix can be adjusted, coins or tokens that are outside the established mix cannot be sorted. The problem is most often encountered when a mass of coins contains coins from more than one country. The present invention provides an apparatus and method which senses each coin as it passes a position on the track in advance of the sorting stations to determine the denomination of the coin. If the denomination sensed is one of the acceptable coins, the coin will be passed to the sorting stations. If the coin or token is not of an acceptable denomination, the sensed coin will be physically moved from the track to an off-sorting station so that it does not reach the sorting stations.

SUMMARY OF THE INVENTION

In accordance with the invention, the track of a coin sorter has a diverter mechanism that can be actuated to divert selected coins from the track to an off-sort position in which they will not encounter the sorting stations. The diverter mechanism preferably takes the form of a shaft of a solenoid that is notched so that it either forms a continuation of the track or a barrier on the track. The off-sort position is defined by an off-sort opening through which the diverted coins will fall.

Further in accordance with the invention, the diverter mechanism is actuated by a coin recognition system that includes an induction coil disposed adjacent the track which senses each coin moving along the track and provides a signal indicative of the denomination of each coin. When a coin of a denomination that is not to be sorted is sensed, the diverter is actuated to deflect that coin. The presence of each coin is sensed before it passes the coil to trigger a response from the coil as each coin approaches.

The coin sensor system can be calibrated for the mix of coins from different countries and for a sample mix of coins for each denomination, and the calibration can be automatically adjusted based on the history of signals from acceptable coins being processed.

The foregoing and other objects and advantages will appear in the following detailed description in which reference is made to the accompanying drawings which illustrate a preferred embodiment of the invention.

BRIEF DESCRIPTION OF THE DRAWINGS

FIG. 1 is a view in perspective of the operating elements of a coin sorter that incorporates the present invention;

FIG. 2 is a partial view in vertical section of the sorting track of the coin sorter of FIG. 1;

DETAILED DESCRIPTION OF THE PREFERRED EMBODIMENTS

Figure 3:
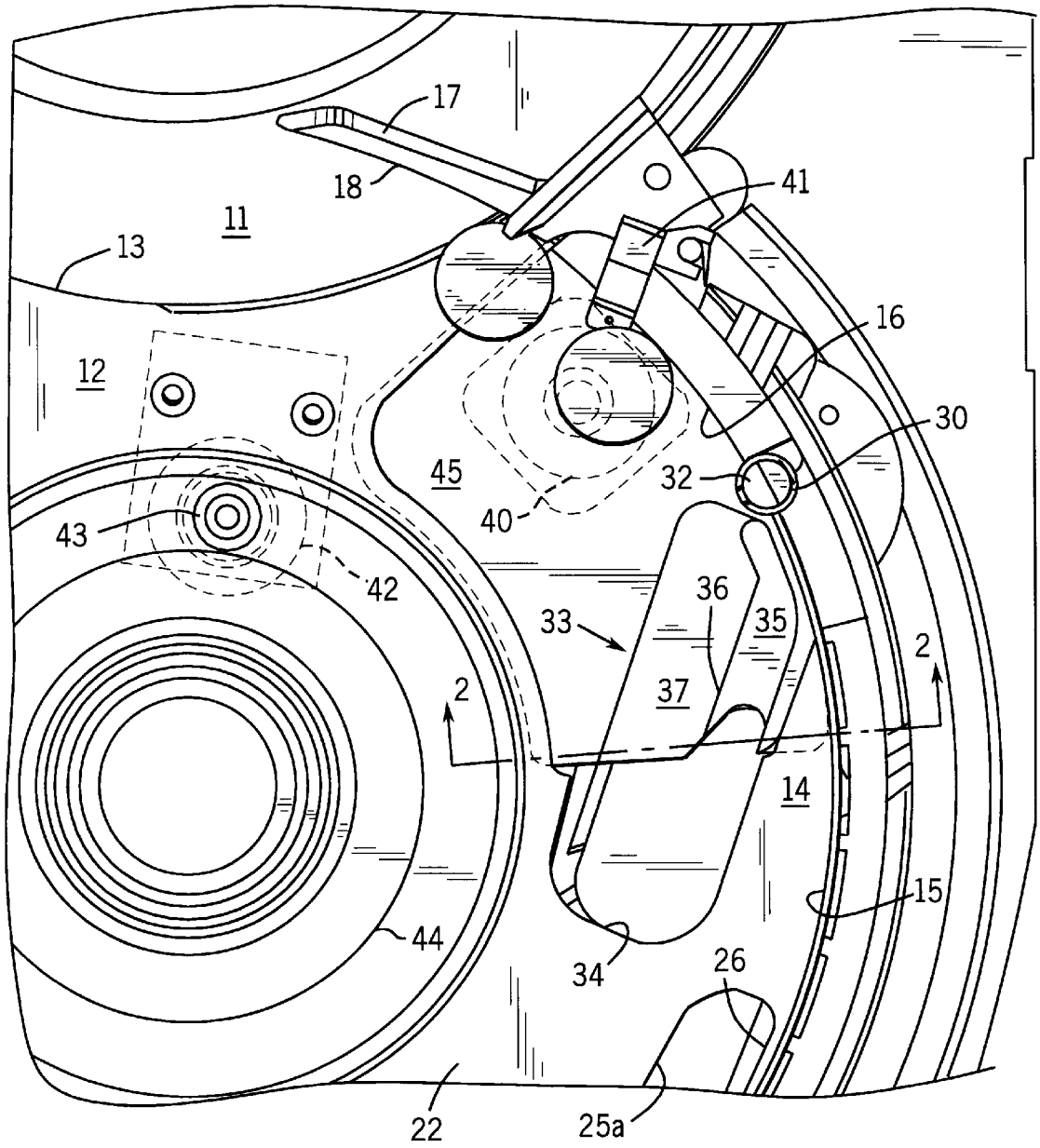
FIG. 3 is a plan view of a portion of the coin sorter incorporating the present invention.

Referring to the drawings, the invention is shown incorporated into a two disc coin sorter such as illustrated and described in U.S. Pat. No. 5,295,899, the disclosure of which is hereby incorporated by reference. The coin sorter has a hopper 10, the bottom of which is defined by a rotating feed disc 11. A sorter plate 12 is disposed adjacent to the feed disc 11 with its upper surface in substantially the same plane as the upper surface of the feed disc 11. The sorting plate 12 is essentially circular except that it has a cut-out 13 in its periphery to accommodate the circular perimeter of the feed disc 11, as shown particularly in FIG. 3.

The sorter plate 12 includes a sorting track 14 defined by an upright circumferential rim 15, a curved wall 16 which precedes the rim 15 and a coin point 17 having a curved upright face 18. The rim 15, wall 16, and upright face 18 all lie substantially in a circle whose center is the center of the sorting plate 12.

A second rotating disc 20 has inner and outer rows of fingers 21*a* and 21*b* that are radially disposed and circumferentially spaced. The fingers 21*a* and 21*b* extend downwardly from the underside of the disc 20. The fingers 21*a* and 21*b* are formed of a rubber or other elastomeric material, such as a polyurethane having a Shore A hardness of about 75. As shown particularly in FIG. 2, each finger 21 extends down to near the top surface 22 (FIG. 3) of the sorter plate 12, as well as the top surface of insert 45 in FIGS. 2 and 3. The distance between the fingers 21 and the top surface 22 is less than the thickness of the thinnest coin to be sorted. The outer row of fingers 21*a* will sweep over a portion of the upper surface of the feed disc 11 where the perimeters of the two discs overlap. The sides of the hopper 10 are open to accept the extending perimeter of the resilient disc 20.

The sorting track 14 includes a series of openings 25*a*, 25*b*, etc. Each of the openings 25 is of an increasing width compared to a preceding opening. The openings 25*a*, 25*b* and 25*c* (FIG. 4) are dimensioned so that there is a small lip 26 (FIG. 3) defined between the radially outer edge of each opening 25*a*, 25*b* and 25*c* and the rim 15. The radially inward side of an opening 25 is spaced from the rim 15 a distance that is just slightly greater than the diameter of a coin to be sorted at that particular opening.

As is known, each opening 25 has associated with it a mechanism for counting coins that fall through the opening. For example, the opening may include a light source (not shown) and an optoelectronic sensor (not shown) arranged such that the path of the light from each source to a respective photocell extends just beneath and along a major length of each opening 25. The passage of a coin through an opening 25 will break the beam of light and be registered on the photocell, thereby providing a signal for each sorted coin of a particular denomination. The signals may be fed to counters that are well-known to the art.

A coin diverter mechanism is positioned at the junction between the curved wall 16 and the end of the rim 15. The coin diverter mechanism takes the form of a shaft 30 of a rotary solenoid 31 which has a notch 32 in its top end. The shaft 30 is rotatable through an arc of 90° by the solenoid 31. The shaft 30 can assume a position as illustrated, for example, in FIGS. 3 and 4 where the notch 32 forms an extension of the track, or the shaft 30 can assume a second position shown, for example, in FIG. 5 in which the shaft projects into the track and deflects coins away from the rim 15. The solenoid 31 is a latching type which must be pulsed to change its state.

Coins deflected from the rim 15 by the shaft 30 are moved by the fingers 21*a* and 21*b* of the rotating disc 20 to an off-sort depression 33 which leads to an opening 34 that is connected to a collection point (not shown) for off-sorted coins. The depression 33 has a horizontal surface 35 at the base of an upright wall 36 that leads from the track to the opening 34. An inclined surface 37 in the depression 33 extends from the top surface 22 of the sorter disc 12 down towards the level of the horizontal surface 35. Coins deflected by the shaft 30 away from the rim 15 will encounter the wall 36 and be guided to the opening 34. Such coins will not, therefore, be passed to the sorting openings 25.

The operation of the rotary solenoid 31 is controlled by a coin recognition system that includes an induction coil 40 mounted beneath the track, an entrance limit optoelectronic sensor 41 that precedes the coil 40, and a rotary encoder 42 having a rubber coated shaft 43 that engages a driver hub 44 that mounts the rotating disc 20. The encoder 42 is used to track the movement of a coin. Preferably, the encoder generates at least 1,000 pulses per revolution. The resulting resolution through the drive train is one pulse for every 0.002 inches of coin movement over the coil 40. The entrance limit sensor 41 is preferably an infrared emitter/receiver pair. The leading edge of a coin interrupts the narrow lightbeam of the sensor 41 to initiate a sampling process to be described. The lightbeam of the entrance sensor 41 is shown in a stylized form in FIGS. 4–6 for purpose of illustration. The entrance limit sensor 41 extends through an opening in the wall 16.

The wall 16, the off-sort depression 33, and the upright wall 36 of the depression are formed in a plug 45 that defines the surface of the sorter plate 12 above the induction coil 40. The plug 45 is preferably formed from a non-conductive, non-metallic ceramic, such as an alumina or zirconia, or from a plastic material.

The induction coil 40 may be a model IWRM 30 U9501 or equivalent inductive linear sensor available from Baumer Electric Ltd. of Southington, Conn. The coil 40 produces a DC analog voltage signal proportional to the damping target distance. For this particular model of sensor, the output will vary between 1 and 9 volts at an operating range of between 5 and 10 mm from a target coin.

The voltage output of the coil 40 is influenced largely by the eddy currents produced within the target coin which are dependent upon the material, thickness, diameter, and position over the face of the coil 40. For any given coin material, as the area or thickness increases, the sensor output voltage decreases. For a given diameter or thickness, aluminum alloys have the least influence upon the sensor output while ferrous alloys cause the greatest voltage reduction.

The induction coil 40 is mounted to a mounting block 47 that attaches to the underside of the plug 45. The face of the coil 40 is received in a recess 48 in the plug 45. The position of the mounting block 47 is adjustable vertically and radially inwardly and outwardly of the upright wall 16 so as to permit positioning of the coil 40 at an optimum location for the mix of coins that it will process.

In overall operation, when the entrance trigger sensor 41 senses the leading edge of a coin, a sequence of sampling of the induction coil 40 begins at predefined increments of coin position as indicated by the encoder 42. The output voltages of the coil 40 are a function of the coin geometry and material characteristics. The signals are processed by a microprocessor and undergo a 12-bit, analog-to-digital conversion which defines the entire voltage range as 4,096 discrete points. If a coin is identified as being part of a programmed set of acceptable denominations, the system will assure that the coin is allowed to pass the diverter shaft 30. If the coin is not accepted, the diverter shaft 30 is rotated to move the coin away from the reference edge defined by the rim 15 and toward the off-sort depression 33 so that the coin will ultimately drop through the off-sort opening 34.

Figure 4:
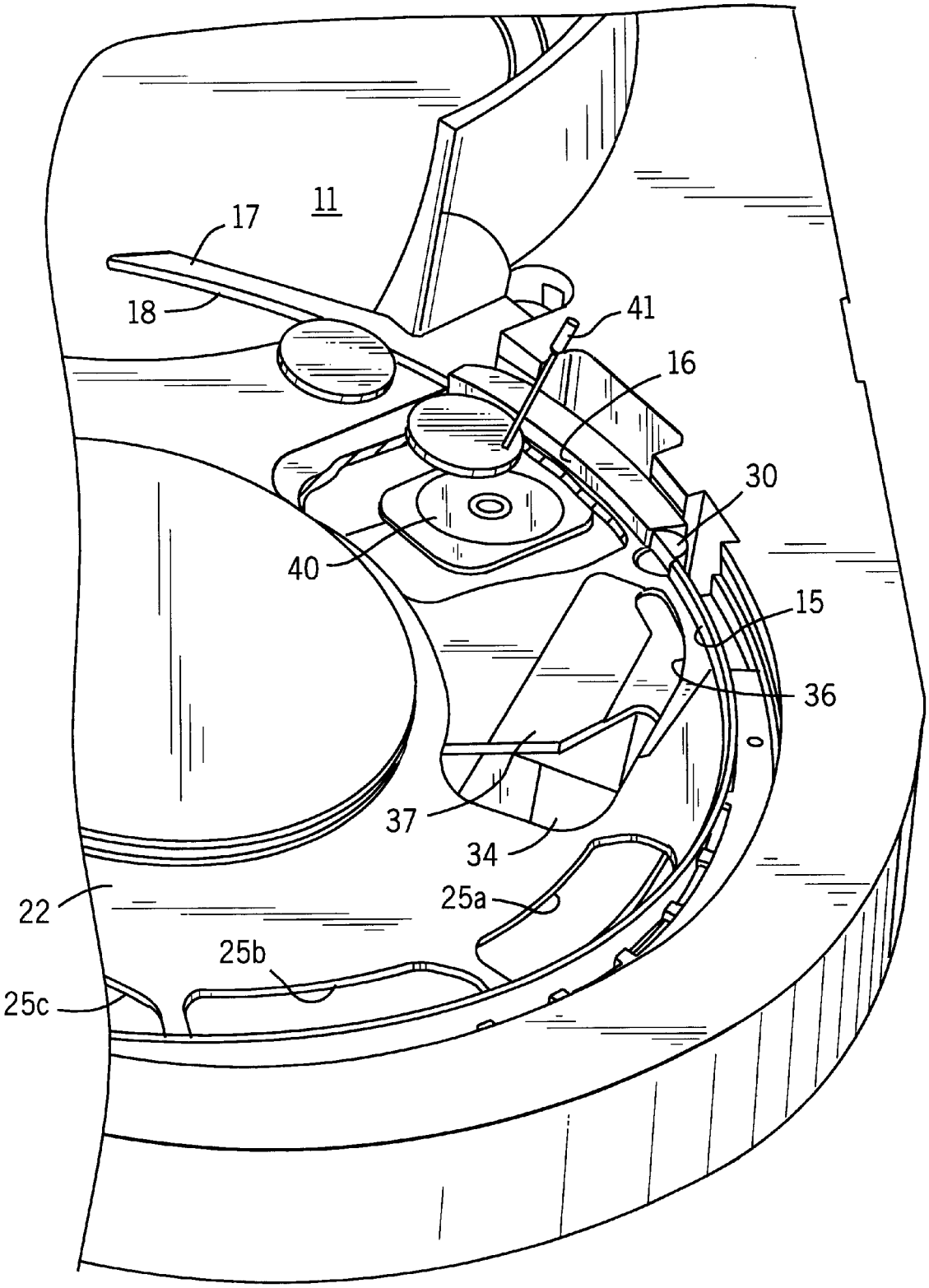
FIGS. 4, 5, and 6 are views in perspective of the coin sorter showing the operation of the invention to reject and pass coins.
Figure 5:
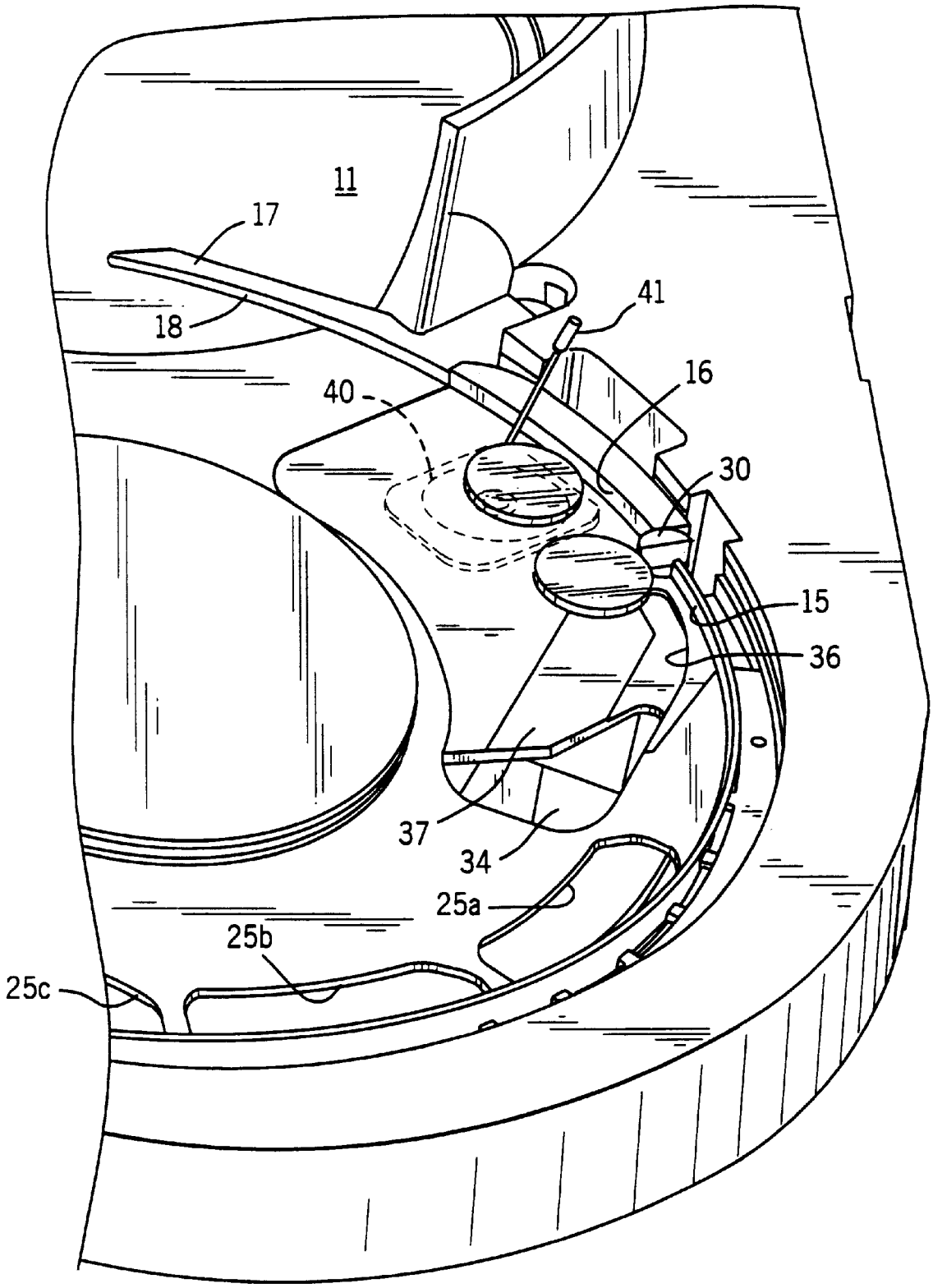
Figure 6:
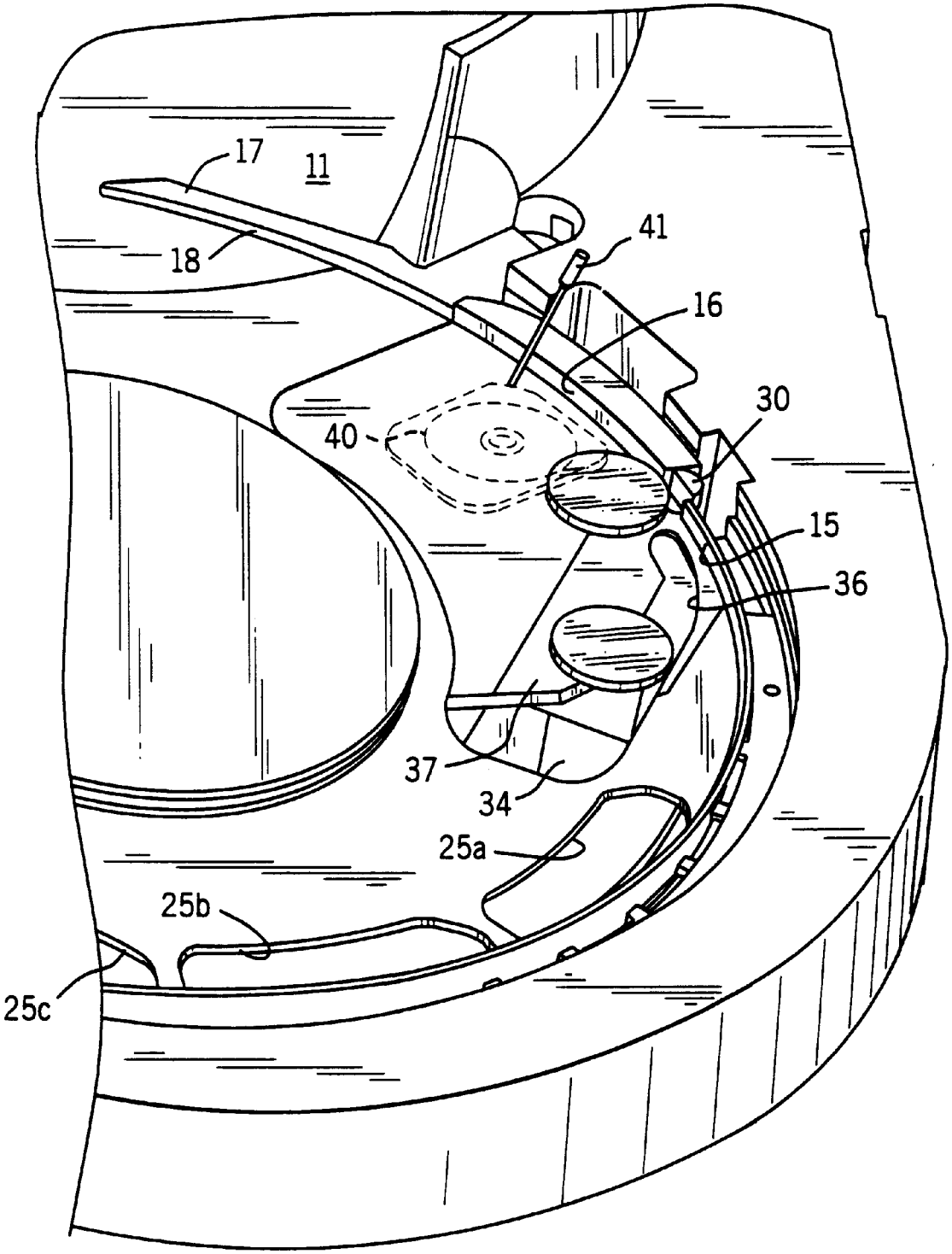
Figure 7:
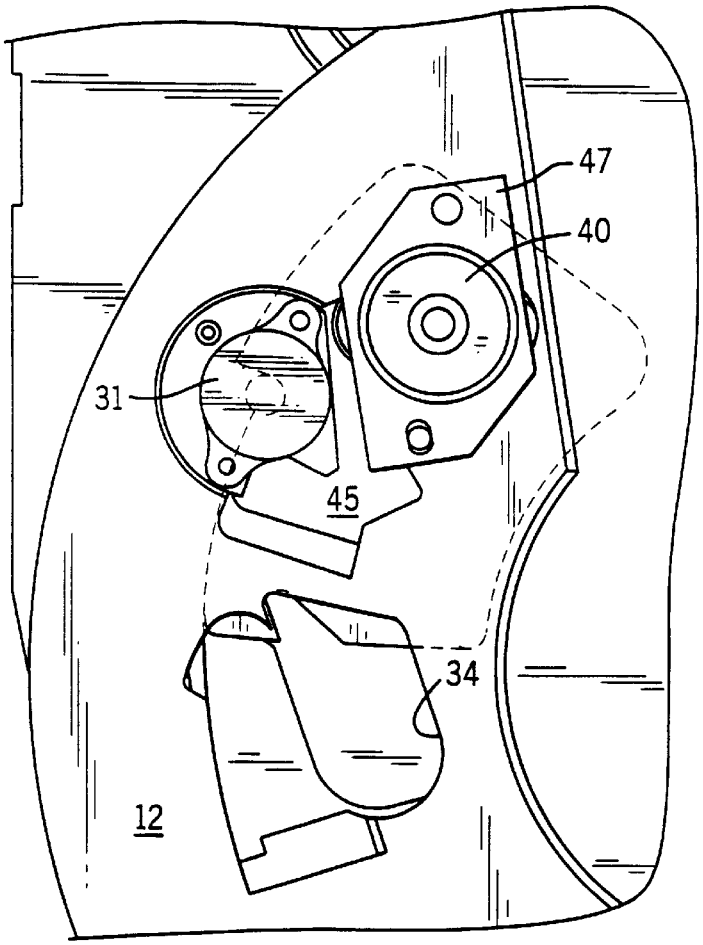
FIG. 7 is a bottom view of the portion of the coin sorter of FIG. 3.
Figure 8:
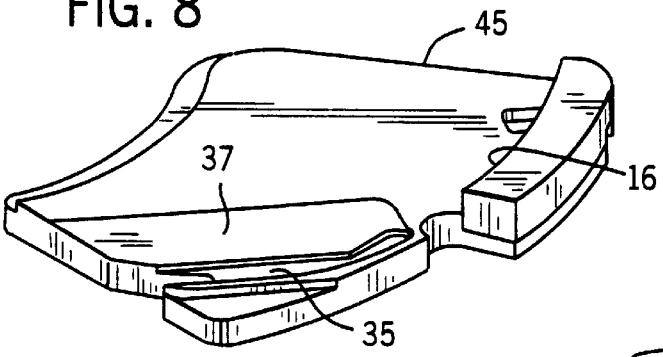
FIGS. 8 and 9 are perspective views of a ceramic plug that is inserted into the surface of the sorting track at the location of the induction coil.
Figure 9:
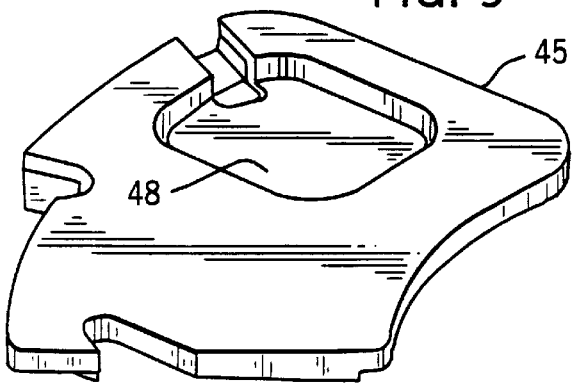

FIGS. 4 through 6 illustrate the passage of two coins past the coil 40. The first coin is unacceptable and diverted away from the rim 15 (FIG. 5) to engage the wall 36 of the depression 33 which carries the coin to the off-sort opening 34 (FIG. 6). The second coin is acceptable and is not diverted from the rim 16.

The control system provides two separate acceptance ranges for each sort opening 25 to allow for situations in which coins of the same denomination are minted from blanks of different alloys.

The microprocessor includes a stored set of instructions for carrying out the normal mode of coin sensing and acceptance or rejection. The stored instructions also provide (i) a calibration of the system by processing a test batch of acceptable coins, (ii) user adjustment of the range of signals that will constitute an acceptance of a coin, and (iii) an automatic adjustment of the acceptance range to compensate for dirt, wear, and mint tolerance.

Figure 10:
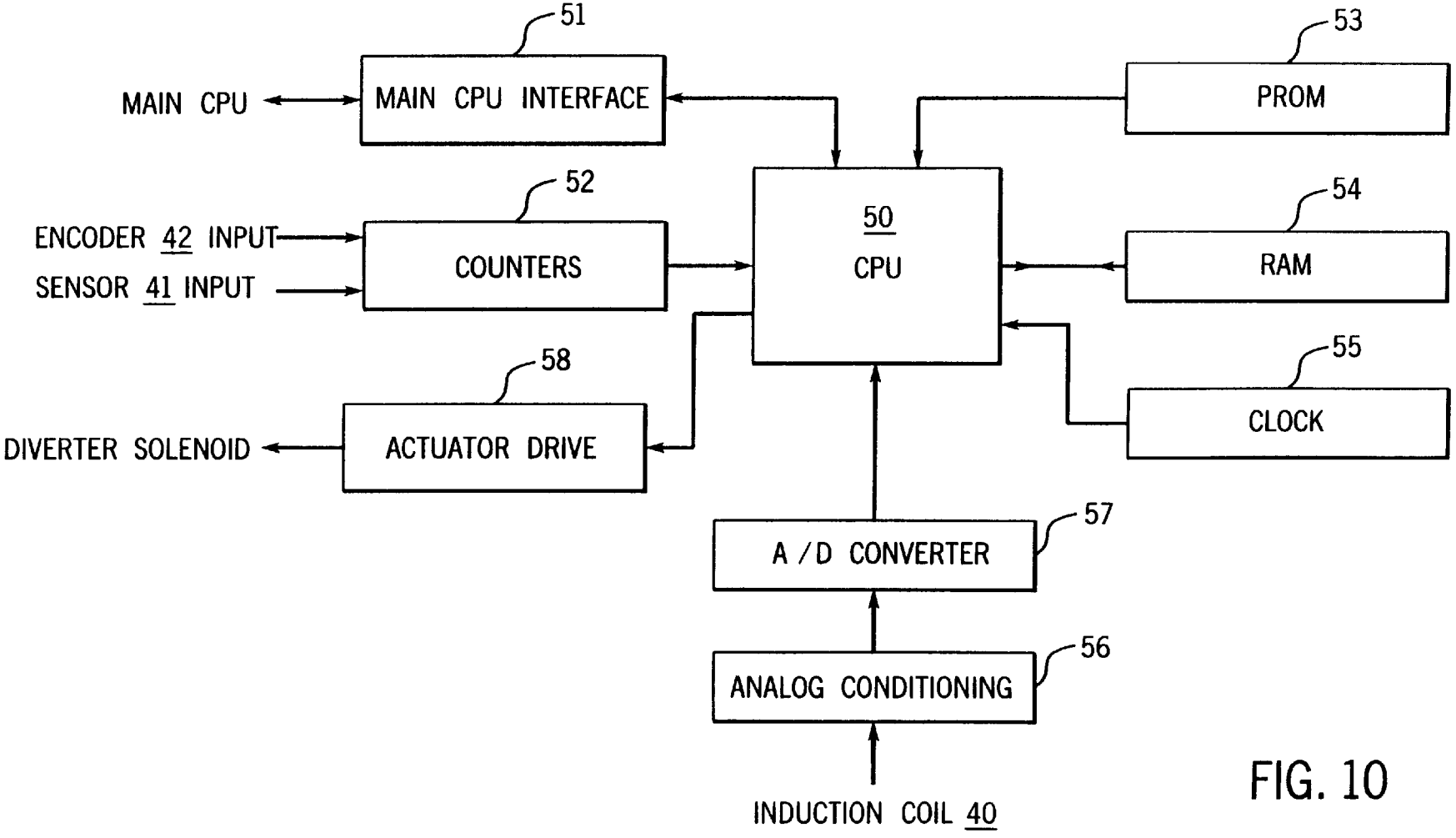
FIG. 10 is a schematic diagram of the element of a microprocessor used to carry out the invention.

Referring to FIG. 10, the microprocessor includes a CPU 50 that is connected by an interface 51 to a main CPU that controls the starting and stopping of the coin sorter, the accumulation of total counts, and other functions which are not a part of the present invention. In the preferred embodiment the CPU 50 is a model Z80 available from Zilog, Inc. Specifications and manuals for programming this CPU are available from the manufacturer. The CPU 50 is driven by clock signals from clock circuit 55.

The CPU 50 connects through the typical address, data and control buses and any necessary decoding circuitry to programmable read only memory (PROM) 53. The PROM 53 stores a firmware program of instructions which are executed by the CPU 50, as more particularly illustrated in FIGS. 11–15 below, and further described below. The CPU 50 also connects through the typical address, data and control buses and any necessary decoding circuitry to a random access memory (RAM) 54 which stores data as the program in PROM is executed. The PROM 53 is preferably 64K and the RAM 54 is preferably 8K.

Also shown in FIG. 10 are a number of input and output devices and associated interface circuitry. A trip sensor input 41 and the encoder 42 are connected to counters 52, which accumulates a digital count in response to the encoder signals. The trip sensor input 41 carries signals to enable or activate the counters 52. The numbers in the counters 52 are read periodically by the CPU 50 to determine the proper reading point of the coin.

The signal from the induction coil 40 is fed to an analog conditioning unit 56 and then to an analog-to-digital convertor 57 with sample and hold input before being read by CPU 50. The CPU 50 reads these signals to develop magnitude values for each coin corresponding to sampled positions identified through the encoder readings. The CPU 50 also generates output signals to control an actuator drive 58 for the diverter solenoid 31.

Figure 11:
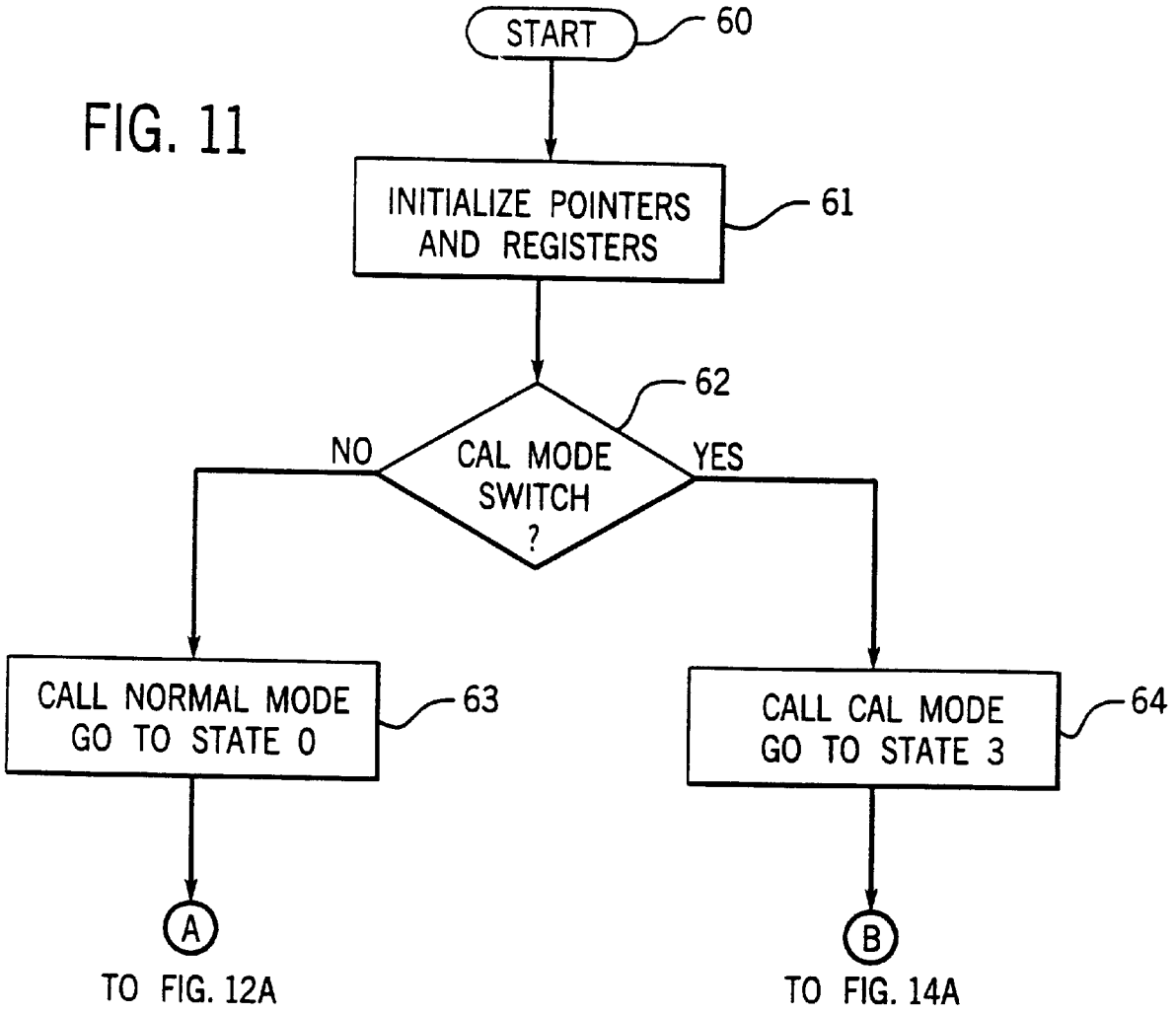
FIG. 11 is a flowchart showing the selection of the mode of operation of the microprocessor.

Referring to FIG. 11 the beginning of execution of the firmware program by the CPU 50 is represented by start block 60. At start-up, instructions represented by process block 61 are executed to initialize pointers and registers. Next, a check is made, as represented by decision block 62, to determine the mode of operation based on input from the main CPU. If the main CPU signals for the calibration mode, as represented by the "YES" branch, the calibration mode (State 3) is entered, as represented by process block 64. If the main CPU signals for the normal mode, as represented by the "NO" branch, the normal mode (State 0) is entered, as represented by process block 63.

Figure 12A:
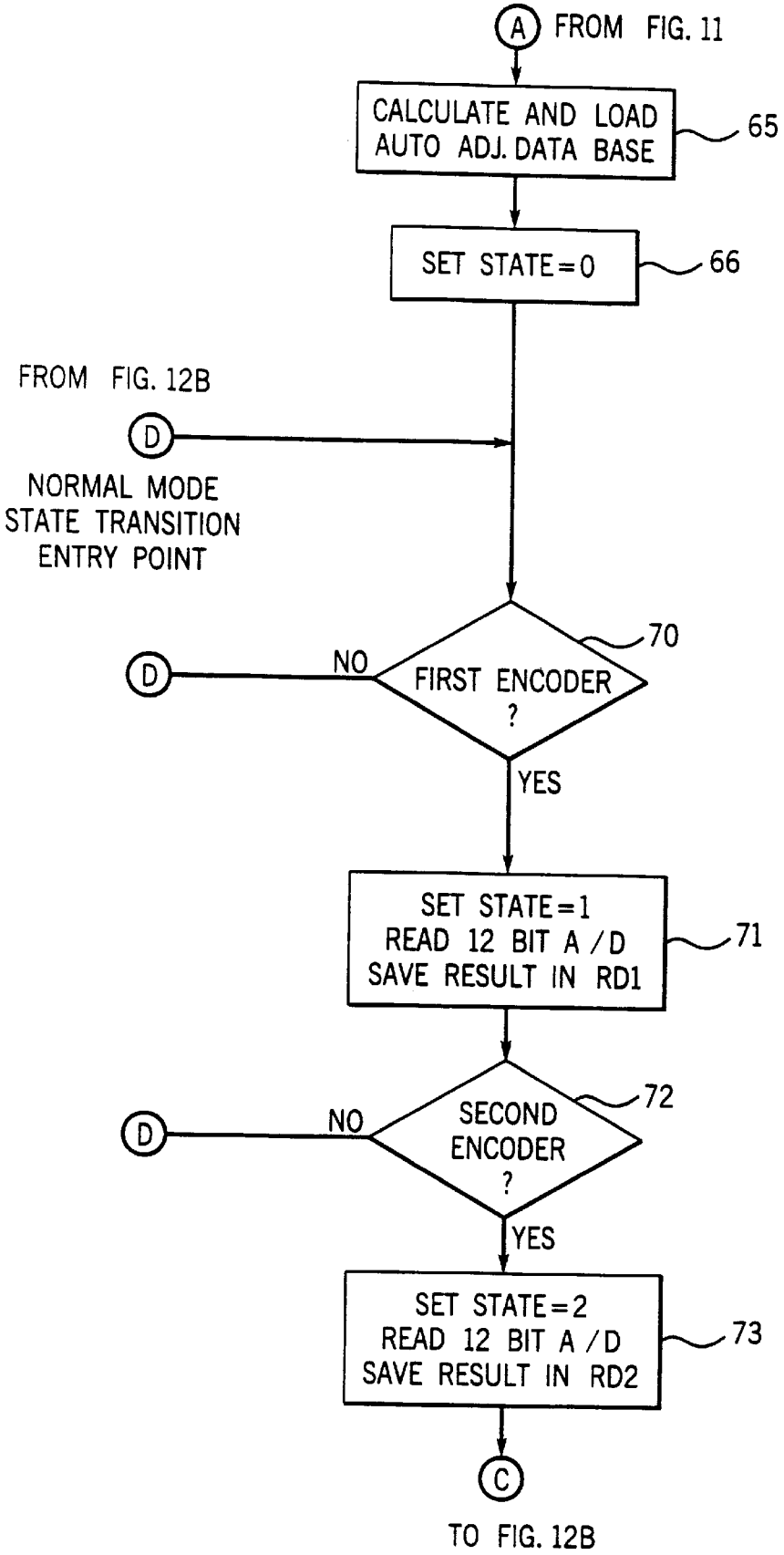
FIGS. 12A and B are a flowchart illustrating the normal mode of operation of the microprocessor to accept and reject coins.

The instruction set for the normal mode of operation is illustrated in FIGS. 12A and B. The next process block 65 is executed to calculate and load a database for the auto adjustment sequence of operations stored in PROM 53. The auto adjustment database allows for deviation of detected coin values within an auto adjust range. Next, instructions are executed, as represented by process block 66 to set a state counter to State 0.

The CPU 50 next executes instructions represented by decision block 70 to determine if the first sampling position has been reached, as determined by inputs from the encoder 42. If the answer is "NO" as represented by the "NO" branch from block 70, the CPU 50 loops back until the answer is "YES," as represented by the "YES" branch of decision block 70. The CPU 50 then advances the state counter to "1" and reads the 12-bit converted value from the coin sensing coil 40 and saves the result in register RD1 in the RAM 54, as represented by process block 71.

The CPU 50 will then execute decision block 72 to determine whether the second sampling position has been reached, as determined by inputs from the encoder 42. If the answer is "NO," as represented by the "NO" branch from block 72, the CPU 50 loops back to decision block 70. If the answer is "YES," as represented by the "YES" branch, the CPU 50 advances the state counter to "2" and reads the 12-bit converted value from the coin sensing coil 40 and saves the result in register RD2 in the RAM 54, as represented by process block 73.

The CPU 50 will then execute decision block 74 to determine whether the third sampling position has been reached, as determined by inputs from the encoder 42. If the answer is "NO," as represented by the "NO" branch from block 74, the CPU 50 loops back to decision block 70. If the answer is "YES," as represented by the "YES" branch, the CPU 50 initializes the auto adjust clear accept flag and reads the 12-bit converted value from the coin sensing coil 40 and saves the result in register RD3 in RAM 54, as represented by process block 75.

The CPU 50 then proceeds to execute instructions for three decision blocks 76, 77 and 78 to see if the numbers in memory locations RD1, RD2 and RD3 are within acceptable ranges stored in RAM 54. Assuming that each of the three values falls within acceptable limits, an accept flag is set through execution of decision block 79. If any one of the three sets of signals falls outside of acceptable ranges, the set accept flag block 79 will not be set.

The CPU 50 then executes instructions represented by decision block 80 to determine if the accept flag is set. If the accept flag has not been set, as represented by the "NO" branch from block 80, process block 85 is executed to generate a reject pulse to the actuator drive 58 which rotates the shaft 30 and causes the diverting of the coin. At the same time, the instruction block 85 sets the state back to 0 before processing of the next coin. If the accept flag has been set, execution of block 86 generates an accept pulse for the solenoid 31 to ensure that the shaft 30 has been rotated out of the way of coins. Instruction block 86 also resets the state counter to "State 0". Next, a determination is made as whether the auto-adjust feature is "on" or "off". This on-off status is controlled by the operator from the front control panel for the sorter. If the auto-adjust feature is "on," as detected by execution decision block 87, the databases for RD1, RD2 and RD3 are adjusted in blocks 88, 89, and 90 with new data read above, and the execution returns to decision block 70. If the auto-adjust feature is turned "off", blocks 88, 89 and 90 are skipped and the execution returns to decision block 70.

Figure 13:
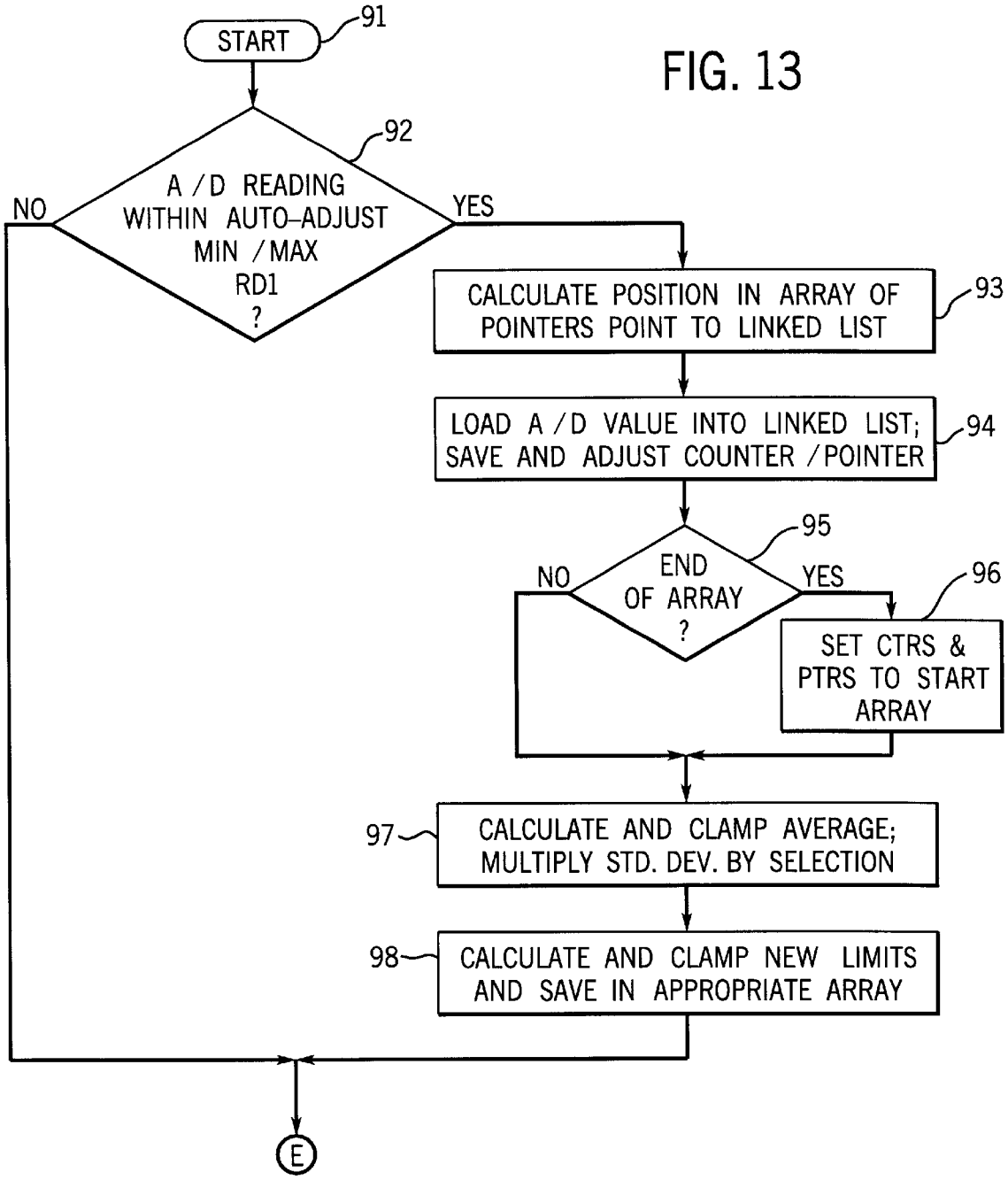
FIG. 13 is a flowchart illustrating the automatic adjustment of the coin calibration while in the normal mode of operation.

The instructions for carrying out the auto-adjust feature in blocks 88, 89 and 90 are more particularly illustrated in FIG. 13, with reference to block 88. A similar routine of instructions would be executed to carry out the routines represented by process blocks 89 and 90.

After the start of the routine, represented by start block 91, a check is made, as represented by decision block 92, to determine whether the signals stored at location RD1 are within the fixed minimum and maximum limits 120 and 121

Figure 17:
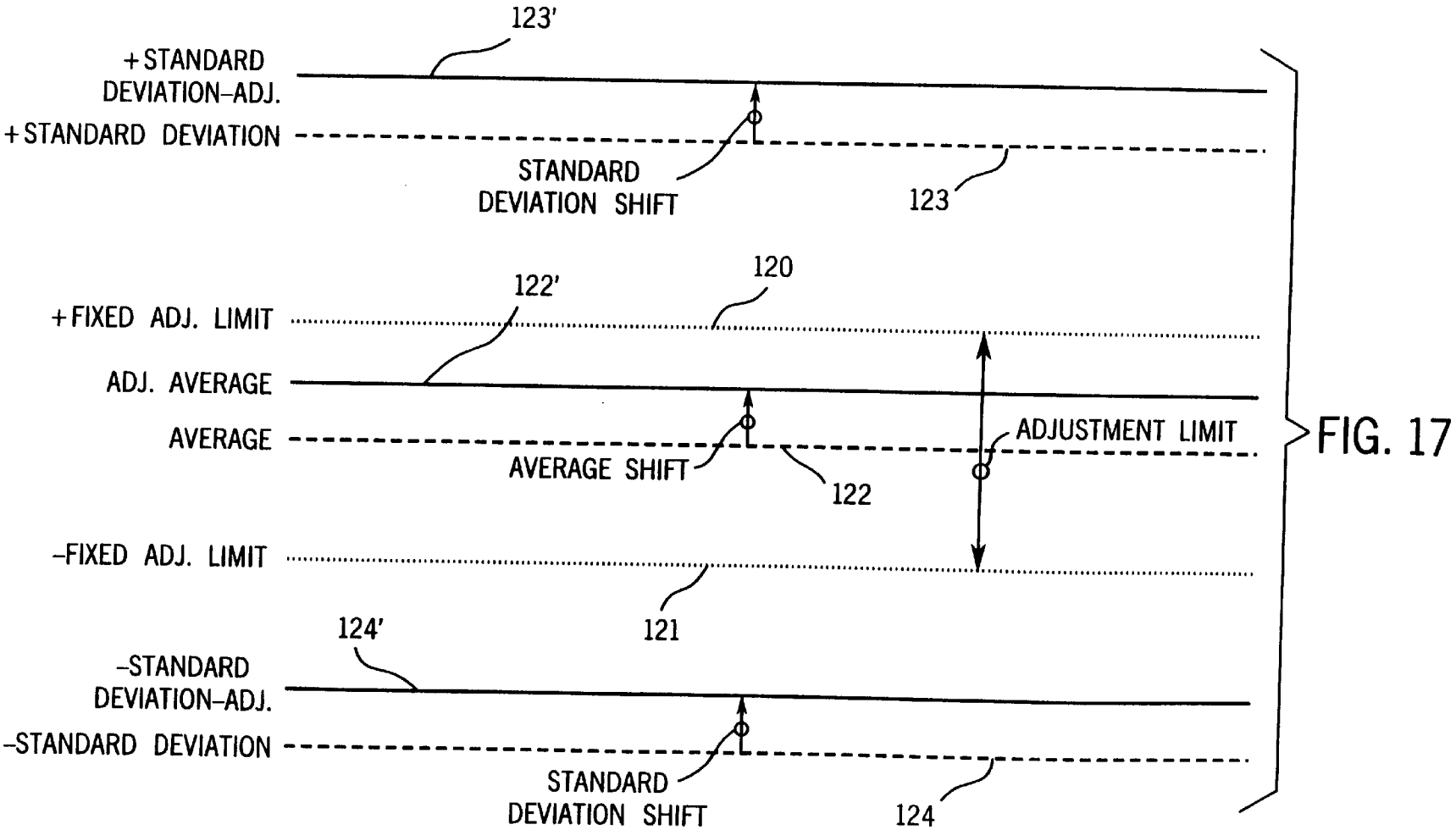
FIG. 17 is a chart illustrating the adjustment of the acceptable range of coins.

(illustrated in FIG. 17). If the first readings are not within such limits, as represented by the "NO" result they are ignored. If they are within the fixed limits, as represented by the "YES" result, then instructions represented by process block 93 are executed to calculate the position in an array for sixteen coins that is to be updated. Then, instructions represented by process block 94 are executed to load the new value into the position in the array, which is maintained in the form of a linked list. Then a check is made for the end of an array, as represented by decision block 95, to determine if values for sixteen coins have been received. If the result in block 95 is "NO," then the routine proceeds to block 97, where the coin data is used to calculate an average for the accumulated coin values. The last sixteen coin values are used to recompute the averages for the array. If the answer is "YES," then the pointers and counters are set to the first memory position in the array. When the next coin value data is received, the data in the first memory position will be overwritten with the new coin value data. Next, process block 97 is executed to calculate a new or adjusted average multiplied by the standard deviation if the answer at decision block 95 was "YES". Next, a process block of instructions 98 is executed to calculate the new limits based upon the adjusted average and the new limits are saved in the appropriate array. The same adjustment is made for each of the other two averages in RD2 and RD3.

Figure 14A:
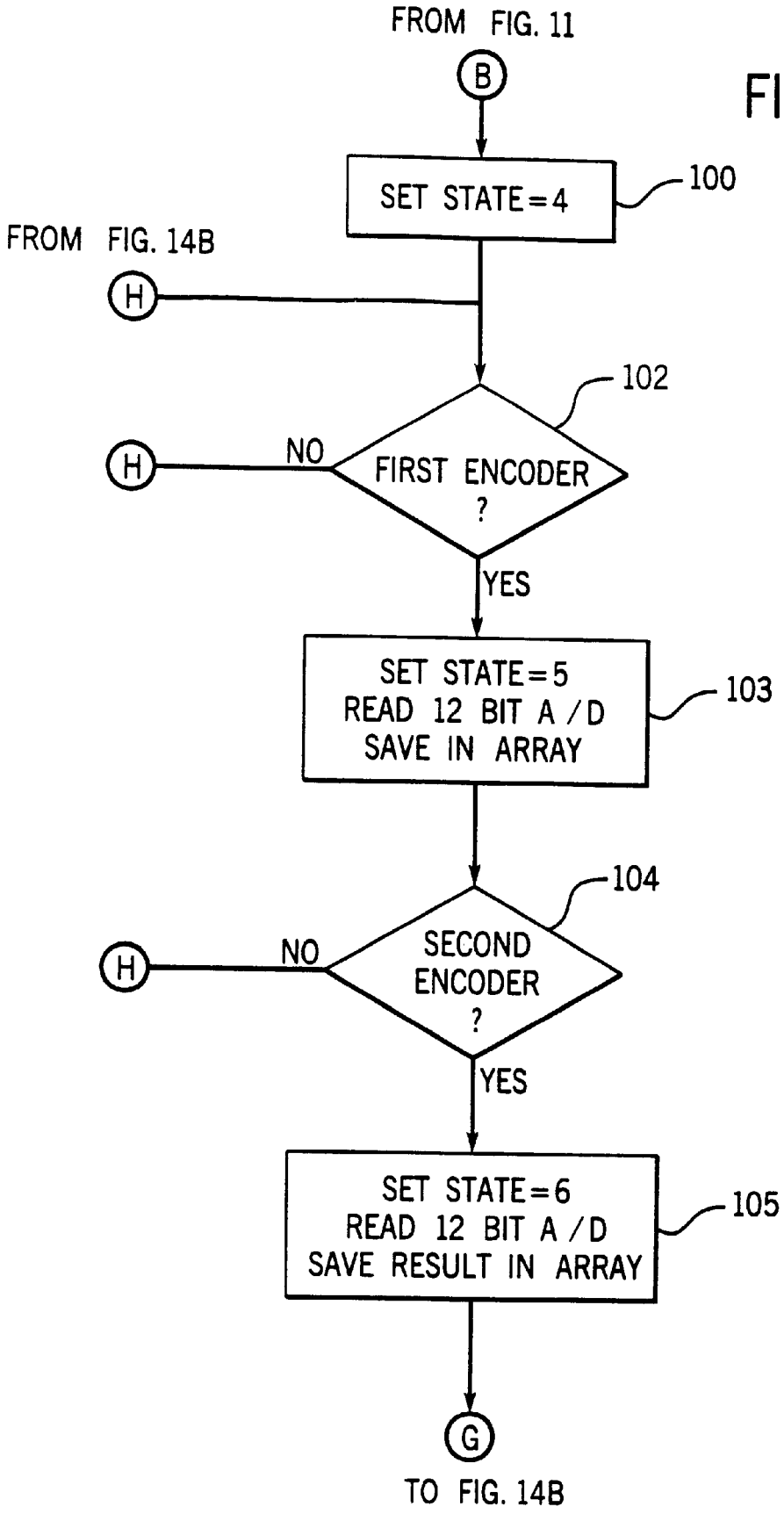
FIGS. 14A and B are a flowchart illustrating the calibration mode of operation of the microprocessor.
Figure 14B:
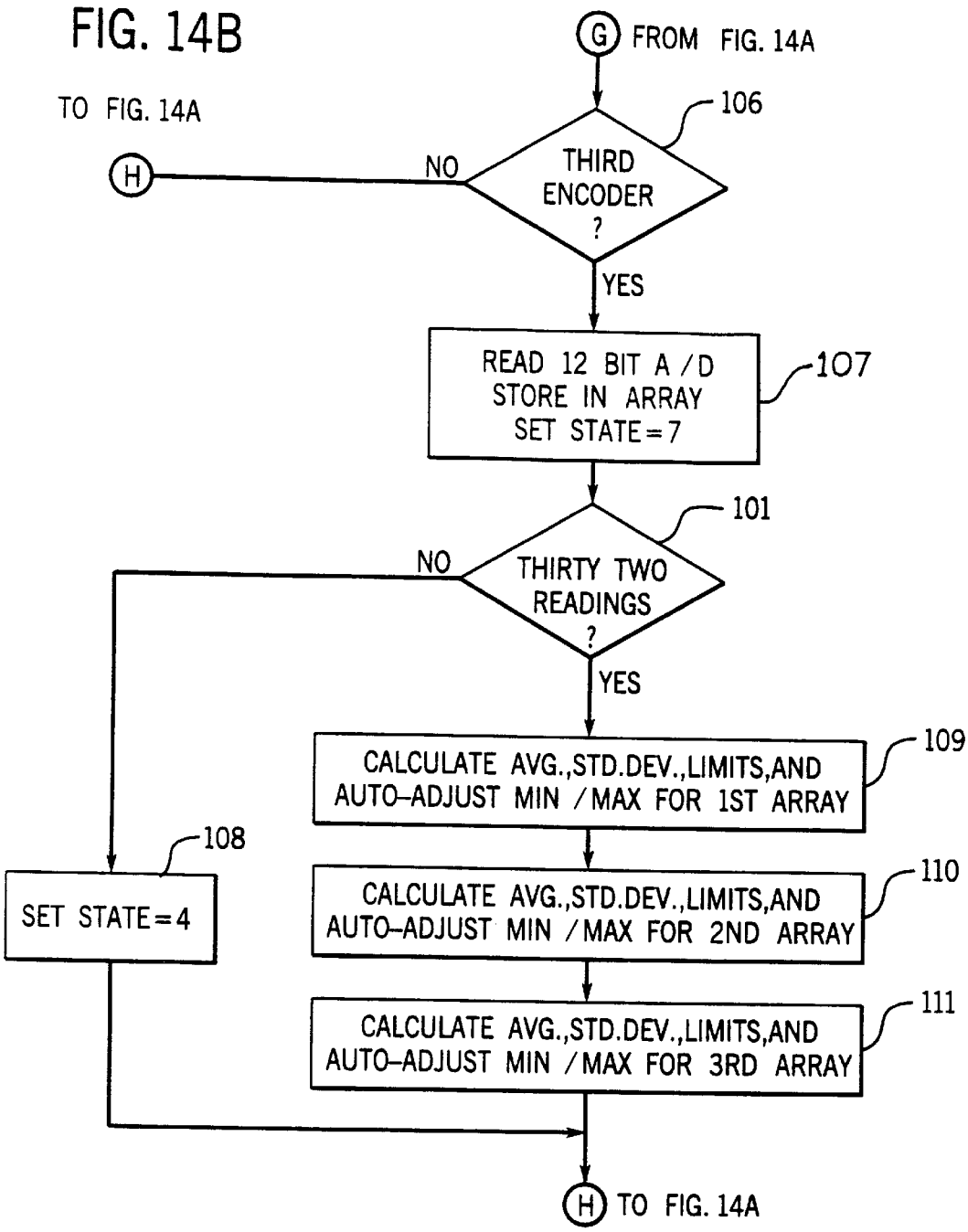

Returning to FIG. 11, assuming the execution of decision block 62 detects the setting of the calibration mode, execution of the program jumps to FIG. 14A.

In the calibration mode of operation illustrated in FIGS. 14A and B, as represented by process block 100, the state counter is set to "State 4." Thirty-two coins are then processed through the coin sorter. Decision block 101 is executed to check the number of coins that have been processed. Three coin detection signals, corresponding to three positions detected by the position encoder 42, are obtained from each of the coins by executing blocks 102 through 107 in the same manner as described for reading coin value signals in the normal mode of operation. State 4 corresponds to the state for reading the first signal, State 5 corresponds to the state for reading the second coin value signal, and State 6 corresponds to reading the third coin value signal. After the third reading is made, as represented by process block 107, the state counter is set to State 7, which is the state for testing for completion of readings for 32 coins, as represented by decision block 101. If the answer is "NO," the state counter is reset to State 4, as represented by process block 108, to begin the three readings for the next coin. If the answer is "YES," the 12-bit converted analog values of the three respective inductive coin detection signals for each coin are used to form a 32-value array for the first, second and third readings for each coin denomination, as represented by process blocks 109, 110 and 111. These arrays are used to calculate values for average value, standard deviation, limits and auto adjust maximum and minimum.

In the calibration mode, the machine operator will typically dump thirty-two known coins into the sorter for processing.

Figure 15:
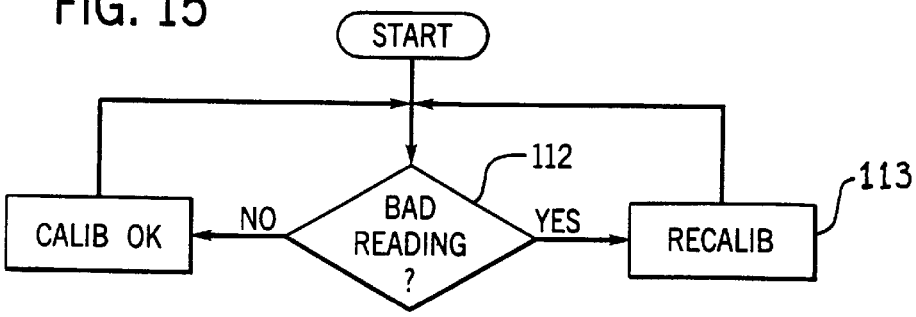
FIG. 15 is a flowchart showing the determination of an invalid calibration mode of operation.

Referring to FIG. 15, if any of the thirty-two readings during the calibration mode are bad, decision instruction block 112 will activate instruction block 113 which will send a message to the main CPU that the calibration was not completed and must be started over.

FIG. 17 illustrates in graphical form the establishment and adjustment of upper and lower acceptable limits for each coin. For each alloy of each coin denomination, fixed upper and lower limits 120 and 121 for the average value are calculated and stored at locations in the RAM 54. In the calibration mode, the average characteristic of coins of that alloy and denomination is determined for each of the three position signals from the induction coil 40. The average is represented in FIG. 17 by the line 122. Standard deviations 123 and 124 from the average 122 are calculated and set in memory. The operator can vary the acceptance range by a multiple of the standard deviation from the control panel of the coin sorter. Using the auto-adjust feature of the present invention, the average can be adjusted to a new value 122' based upon the history of acceptable coins of that denomination and alloy which are processed following calibration. Not only will the average be adjusted, but the upper and lower levels 123 and 124 of the standard deviation will be similarly adjusted to new levels 123' and 124'. Such adjustments may be necessary to compensate for temperature changes, wear, and other operating conditions. The adjusted average can never, however, fall outside of the fixed limits 120 and 121 because to do so might place the adjusted average and its adjusted standard deviations into the range of acceptable limits of another denomination of coin.

Figure 16:
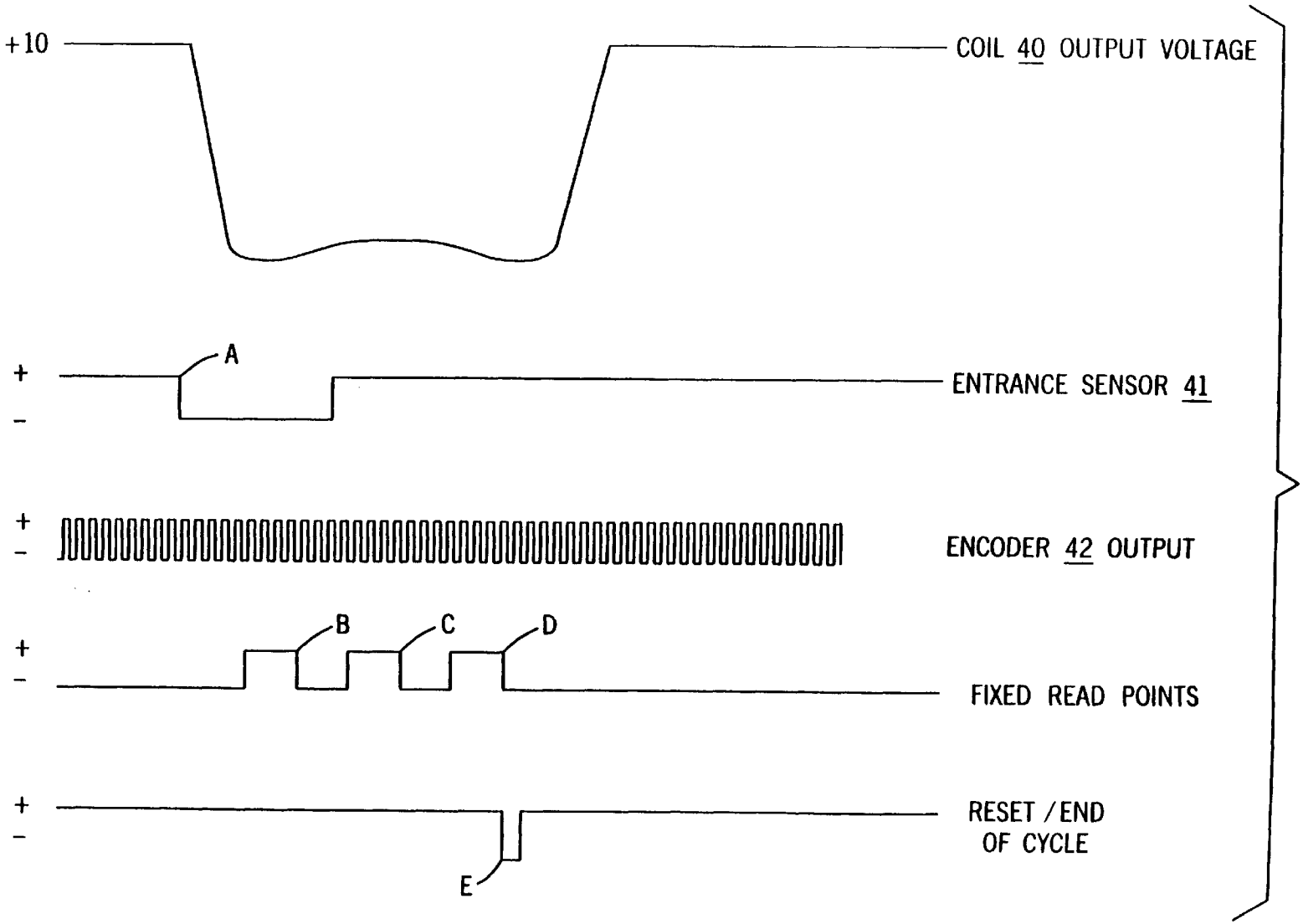
FIG. 16 is a timing chart illustrating the operation of the sensor coil and encoder used in the invention.

FIG. 16 illustrates the relative timing of the three signals from the coil 40 that are used in the coin recognition system in relation to the signals from the entrance sensor 41 and the encoder 42. In an alternate method of operation, additional fixed read points may be used in addition to the three illustrated in FIG. 16, and three of the multiple read points selected for use based upon other characteristics of a coin. For example, five fixed read points may be established. If a coin passes by the entrance sensor 41 for a shorter distance, with the number of encoder pulses indicating that it is a small coin, the second, third, and fourth signals at the read points would be used. If a coin passes by the entrance sensor 41 for a longer distance, with the number of encoder pulses, indicating that it is a larger coin, the signals at the first, third, and fifth read points would be used.

We claim:

1. A coin handling machine having a sorting plate with a series of sorting stations arranged along a circular rim, the coin handling machine further comprising:

a rotatable drive disc above the sorting plate for positive control of coins as the coins are moved in a single layer and eventually in a single file along a coin track to the sorting stations;

a diverter mechanism located at the rim in advance of the sorting stations and adapted when actuated to move coins laterally inward from the coin track;

an off-sort opening in the sorting plate located completely laterally inward of the coin track to receive coins that are moved by the diverter mechanism and to remove said coins from further automatic sorting operations;

an induction coil adjacent the rim and beneath the sorting plate in advance of the diverter mechanism, the coil providing an analog signal indicative of each coin passing the coil; and a control system containing stored ranges of signals for acceptable coins, the control system being responsive to the coil signals to actuate the diverter mechanism whenever the coil signals are outside of the stored ranges for acceptable coins.

2. A coin handling machine according to claim 1, wherein the diverter mechanism comprises a shaft of a rotary solenoid having a substantially flat portion that is positioned in alignment with the rim when the shaft is in a first position and having another portion which projects into the coin path when the shaft is in a second position; and an inwardly turning guide edge positioned between the shaft of the rotary solenoid and the off-sort opening for maintaining control of coins after the coins have been moved laterally inward by the diverter mechanism towards the off-sort opening.

3. A coin recognition apparatus according to claim 1, wherein the control system includes a microprocessor, a memory electrically connected to the microprocessor for storing the range of signals for acceptable coins, an analog-to-digital converter for converting the analog coil signals to digital signals fed to the microprocessor, and an actuator drive for the diverter mechanism.

4. In a coin handling machine having a sorting plate with a series of sorting stations arranged along a circular rim and a rotatable drive disc above the sorting plate for moving a single layer of coins and eventually a single file of coins along the rim, the combination therewith of a coin recognition apparatus comprising:

a diverter mechanism located at the rim in advance of the sorting stations and adapted when actuated to move coins laterally inward from the rim;

an off-sort opening in the sorting plate spaced laterally inward from the rim to receive coins that are moved by the diverter mechanism;

an induction coil adjacent the rim and beneath the sorting plate in advance of the diverter mechanism, the coil providing an analog signal indicative of each coin passing the coil;

a control system containing stored ranges of signals for acceptable coins, the control system being responsive to the coil signals to actuate the diverter mechanism whenever the coil signals are outside of the stored ranges for acceptable coins;

an entrance sensor disposed in the path of travel of the coins immediately in advance of the coil, the entrance sensor providing a signal to the control system when each coin passes the sensor; and an encoder connected to rotate with the drive disc and providing a position signal to the control system; and wherein the control system reads digital values corresponding to the coil signals at a plurality of fixed positions determined by the encoder signals following a signal from the entrance sensor that a coin is present.

5. A coin recognition apparatus according to claim 4, wherein a number of the coil signals for a corresponding plurality of fixed positions read by the control system varies with the distance traveled by the coin past the entrance sensor.

6. A coin recognition system for identifying coins as the coins are passed in series past a coin detection station, comprising:

an induction coil positioned on one side of the coin detection station and providing a plurality of signals indicative of a magnitude of a selected parameter as one of said coins passes the induction coil;

a position detector responsive to movement of each of the coins into the coin detection station to generate a position signal;

a memory containing stored ranges of digital values of the selected parameter for acceptable coins; and a central processing unit connected to read a plurality of digital values corresponding to analog signals from the induction coil for the selected parameter during a corresponding plurality of sampling periods which further correspond to a plurality of positions for a sample coin as it passes the induction coil, said central processing unit comparing the plurality of digital values for the selected parameter for the sample coin to the stored ranges to determine if the sample coin is acceptable.

7. A coin recognition system according to claim 6, wherein the position detector comprises a sensor at the entrance to the station, a position sensing device responsive to the location of coins in the station, and a counter responsive to the sensor and position sensing device to generate a series of counts after the sensor senses the presence of a coin, the plurality of positions at which the signals are read being defined by the counts.

8. A coin according to claim 6, wherein the central processing unit makes first, second, third, fourth and fifth readings corresponding to first, second, third, fourth and fifth sampling periods and compares the first, third, and fifth readings to the stored ranges unless the sensor indicates the absence of a coin before the fifth reading, in which event the central processing unit compares the second, third, and fourth readings with the stored ranges.

9. A method of discriminating between acceptable and unacceptable coins in a stream of coins passing seriatim over an inductive field, comprising:

generating an entrance signal as each coin enters the inductive field;

in response to the entrance signal detecting a plurality of analog signals for a selected coin parameter as each coin passes through the inductive field;

reading the plurality of analog signals during a corresponding plurality of sampling periods;

comparing values corresponding to the plurality of analog signals to a preselected range of signals for acceptable coins; and wherein the preselected range of signals for acceptable coins is determined by passing a sample quantity of acceptable coins of a single denomination over the inductive field and averaging the readings for the analog signals corresponding to the sample quantity of acceptable coins; and wherein the range of signals for acceptable coins includes an average value and selectable standard deviations above and below the average value.

10. A method according to claim 9, wherein the range of signals is adjusted based upon the average value of acceptable coins that have passed through the field.

11. A method according to claim 10, wherein an upper and a lower limit for the average value is fixed and constrains the adjustment.

12. A coin handling machine having a sorting plate with a series of sorting stations arranged along a reference edge, the coin handling machine further comprising:

a drive member above the sorting plate for positive control of coins as the coins are moved in a single layer and eventually in a single file on a coin path along the reference edge;

a diverter mechanism located at the reference edge in advance of the sorting stations and adapted when actuated to move coins laterally inward from the reference edge;

a depression in the sorting plate located away from the reference edge to receive coins that are moved laterally inward by the diverter mechanism; and an off-sort opening in the sorter plate at the end of the depression and laterally spaced inward from the reference edge.

13. A coin handling machine according to claim 12, wherein the diverter mechanism comprises a shaft of a rotary solenoid having a substantially flat portion that is positioned in alignment with the reference edge when the shaft is in a first position and having another portion which projects into the coin path when the shaft is in a second position; and an inwardly turning guide edge positioned between the shaft of the rotary solenoid and the off-sort opening for maintaining control of coins after the coins have been moved laterrally inward by the diverter mechanism towards the off-sort opening.

14. In a coin handling machine having a sorting plate with a series of sorting stations arranged along a reference edge and a drive member above the sorting plate for moving a plurality of coins and eventually a single file of coins along the reference edge, the combination therewith of:

a diverter mechanism located at the reference edge in advance of the sorting stations and adapted when actuated to move coins away from the reference edge;

a depression in the sorting plate located away from the reference edge to receive coins that are moved by the diverter mechanism;

an off-sort opening in the sorter plate at the end of the depression;

an induction coil adjacent the reference edge and beneath the sorting plate in advance of the diverter mechanism, the coil providing a signal indicative of a magnitude of a selected coin parameter as a coin passes the coil; and a control system containing stored ranges of signals of the selected parameter for acceptable coins, the control system being responsive to the coil signals to actuate the diverter mechanism whenever the coil signals are outside the stored ranges for acceptable coins.

15. A method of calibrating a coin sorting and counting machine, the method comprising:

detecting selection of a calibration mode of operation;

providing signals indicative of a magnitude of a selected coin parameter as a plurality of sample coins of a selected denomination pass a coin parameter detection device in a coin detection station during operation of the machine in the calibration mode;

sampling the signals representing the magnitude of the selected coin parameter for the plurality of sample coins, and for a plurality of positions in the coin detection station for each sample coin as the plurality of sample coins pass through the coin detection station during operation of the machine in the calibration mode; and calculating an average value for the selected coin parameter for the plurality of positions for the plurality of sample coins.

16. A method according to claim 15, further comprising the step of:

calculating a standard deviation factor for the selected coin parameter for the plurality of positions for the plurality of sample coins.

17. A method according to claim 15, further comprising the steps of:

setting minimum and maximum limits for the average value of the selected coin parameter for the plurality of positions at which the magnitude of the coin parameter is to he sampled.

18. The method according to claim 15 in which the plurality of sample coins includes at least thirty-two coins of a selected denomination.

19. A method of operating a coin sorting and counting machine, the method comprising:

providing signals indicative of a magnitude of a selected coin parameter as a coin of a selected denomination passes a coin parameter detection device in a coin detection station;

detecting positions of the coin as the coin pass through the coin detection station;

sampling the magnitude of the selected coin parameter for the coin at a plurality of positions in the coin detection station as the coin passes through the coin detection station; and adjusting an average value of the selected coin parameter for the respective coin positions for comparison to detected values for the selected coin parameter during operation of the machine.

20. The method of claim 19, further comprising the step of adjusting a standard deviation factor of the selected coin parameter based on detected values for a plurality of coins passing through the coin detection station.

21. The method of claim 19, further comprising the step of determining that an adjustment to the average value is within minimum and maximum average value limits before allowing a change in a reference average value.

* * * * *